US010329885B2

(12) United States Patent
Acker et al.

(10) Patent No.: US 10,329,885 B2
(45) Date of Patent: Jun. 25, 2019

(54) SELF-SEALING PERFORATING APPARATUS

(71) Applicant: HALLIBURTON ENERGY SERVICES, INC., Houston, TX (US)

(72) Inventors: Jeffery Richard Acker, Duncanville, TX (US); Christopher C. Hoelscher, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 282 days.

(21) Appl. No.: 15/315,055

(22) PCT Filed: Jul. 22, 2014

(86) PCT No.: PCT/US2014/047661
§ 371 (c)(1),
(2) Date: Nov. 30, 2016

(87) PCT Pub. No.: WO2016/014038
PCT Pub. Date: Jan. 28, 2016

(65) Prior Publication Data

US 2017/0191354 A1 Jul. 6, 2017

(51) Int. Cl.
*E21B 43/119* (2006.01)
*E21B 33/138* (2006.01)
(Continued)

(52) U.S. Cl.
CPC ..... *E21B 43/119* (2013.01); *E21B 33/13* (2013.01); *E21B 33/138* (2013.01);
(Continued)

(58) Field of Classification Search
CPC ..... E21B 33/13; E21B 33/138; E21B 43/103; E21B 43/11; E21B 43/117; E21B 43/119
See application file for complete search history.

(56) References Cited

U.S. PATENT DOCUMENTS 2,424,701 A 2/1941 Merrill
2,749,840 A * 6/1956 Babcock ..... E21B 43/117 102/319

(Continued)

FOREIGN PATENT DOCUMENTS

EP 1407113 B1 3/2006

OTHER PUBLICATIONS

Spenadel, Lawrence, "Synthetic Rubber for Self-Sealing Fuel Tanks", vol. 51, No. 8 , Aug. 1959, pp. 935-936.

(Continued)

*Primary Examiner* — Caroline N Butcher
(74) *Attorney, Agent, or Firm* — Polsinelli PC

(57) ABSTRACT

A perforating apparatus incorporating a selective self-sealing material is disclosed for sealing exit holes in a wall of the apparatus resulting from perforation operations. The perforating apparatus traps debris produced during downhole perforation operations and prevents the debris from entering the wellbore which avoids the need for remedial operations to remove debris from the wellbore. The self-sealing material may be disposed within the perforating apparatus adjacent to an interior surface of the wall or the self-sealing material may be disposed outside the perforating apparatus adjacent to an exterior surface of the wall. The self-sealing material may include an expandable polymer material, a swelling elastomer, a rubber and combinations thereof.

18 Claims, 7 Drawing Sheets

(51) Int. Cl.

| | |
|---|---|
| ***E21B 43/117*** | (2006.01) |
| ***E21B 33/13*** | (2006.01) |
| ***E21B 43/10*** | (2006.01) |
| ***E21B 43/11*** | (2006.01) |

(52) U.S. Cl.
CPC ..... *E21B 43/103* (2013.01); *E21B 43/11* (2013.01); *E21B 43/117* (2013.01)

(56) References Cited

U.S. PATENT DOCUMENTS

| | | | | |
|---|---|---|---|---|
| 2009/0050323 | A1 | 2/2009 | Walker | |
| 2011/0221137 | A1 | 9/2011 | Obi et al. | |
| 2012/0198988 | A1 | 8/2012 | Volberg et al. | |
| 2013/0098617 | A1* | 4/2013 | Walker ..... | E21B 43/117 166/297 |

OTHER PUBLICATIONS

International Search Report and Written Opinion; PCT Application No. PCT/US2014/047661; dated Apr. 15, 2015.

* cited by examiner

SELF-SEALING PERFORATING APPARATUS

CROSS-REFERENCE TO RELATED APPLICATIONS

This application is a national stage entry of PCT/US2014/047661 filed Jul. 22, 2014, said application is expressly incorporated herein in its entirety.

FIELD

The subject matter of the present disclosure generally relates to a perforating apparatus. The subject matter more specifically relates to a perforating apparatus that includes self-sealing material.

BACKGROUND

In open-hole and cased-hole wellbores used to extract hydrocarbons from subterranean formations, it is often necessary to create perforations and/or fractures near the wellbore to establish communication between a reservoir and the wellbore. Perforating and fracturing may, however, create debris that is undesirable in the wellbore. For instance, debris may damage wellbore equipment and may damage surface equipment. Debris may also damage the wellbore itself and/or formation perforations. Debris may also plug off casing and/or tubing exit holes. Such damage or plugging off may require remedial work and/or equipment replacement. Performing remedial work and repairing or replacing wellbore equipment and surface equipment damaged by downhole debris may be costly and time consuming and is therefore avoided where possible.

BRIEF DESCRIPTION OF THE DRAWINGS

Implementations of the present technology will now be described, by way of example only, with reference to the attached figures, wherein:

FIG. 12(*b*) is a schematic diagram illustrating the elastomers shown in FIG. 12(*a*) in a partially swollen state; and FIG. 12(*c*) is a schematic diagram illustrating the elastomers shown in FIGS. 12(*a*) and 12(*b*) in an extensively swollen state.

DETAILED DESCRIPTION

Figure 1:
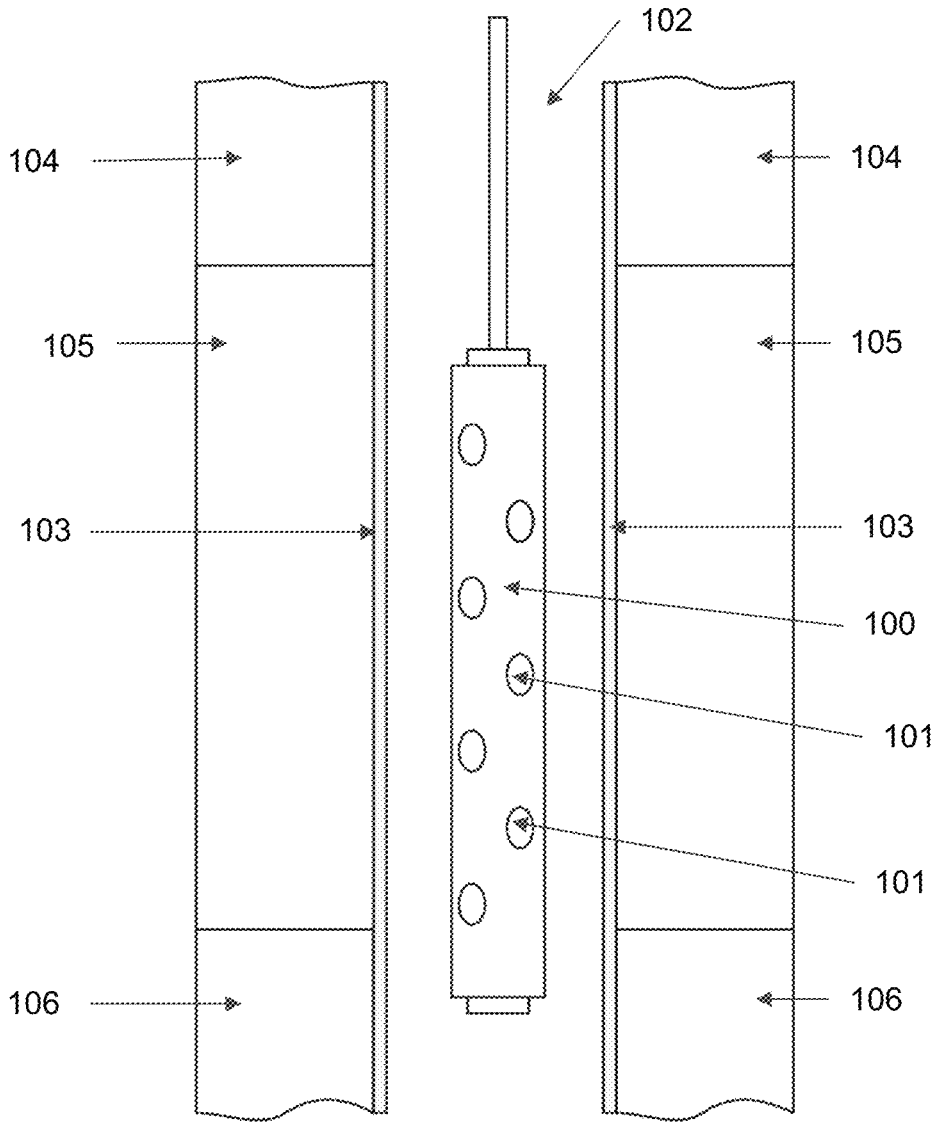
FIG. 1 is a schematic diagram showing a perforating apparatus inserted into a wellbore.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, the embodiments described herein may be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of the wellbore might be deviated or horizontal. Correspondingly, the transverse, axial, lateral, longitudinal, radial, etc., orientations shall mean orientations relative to the orientation of the wellbore or tool. Additionally, in the illustrated embodiments, the depictions are orientation such that the right-hand side is downhole compared to the left-hand side.

Several definitions that apply throughout this disclosure will now be presented.

The term "outside" refers to a region that is beyond the outermost confines of a physical object. The term "inside" indicates that at least a portion of a region is partially contained within a boundary formed by the object.

All numeric values are assumed to be modified by the term "about," whether or not explicitly indicated. The term "about" generally refers to a range of numbers that one of skill in the art would consider as functionally equivalent to the recited value (in other words, having the same function or capable of causing the same or a similar result). In many instances, the term "about" can include numbers that are rounded to the nearest significant digit.

The present disclosure describes a perforating apparatus that incorporates at least one selectively self-sealing material that seals or partially seals any exit hole or holes in the perforating apparatus. Sealing or partially sealing the exit hole or holes in the perforating apparatus may cause perforating apparatus debris (debris resulting from the use of the perforating apparatus) to be trapped inside the perforating apparatus. Since the debris is trapped inside the perforating apparatus, the debris is prevented from entering the wellbore.

Referring to FIG. 1, a schematic diagram shows a perforating apparatus 100. The perforating apparatus 100 may include one or more scalloped areas 101. The perforating apparatus 100 may be lowered into a wellbore 102 that may be lined with a metal casing 103. The perforating apparatus 100 may be positioned at a depth aligned with one or more desired strata 104, 105, 106.

Figure 2:
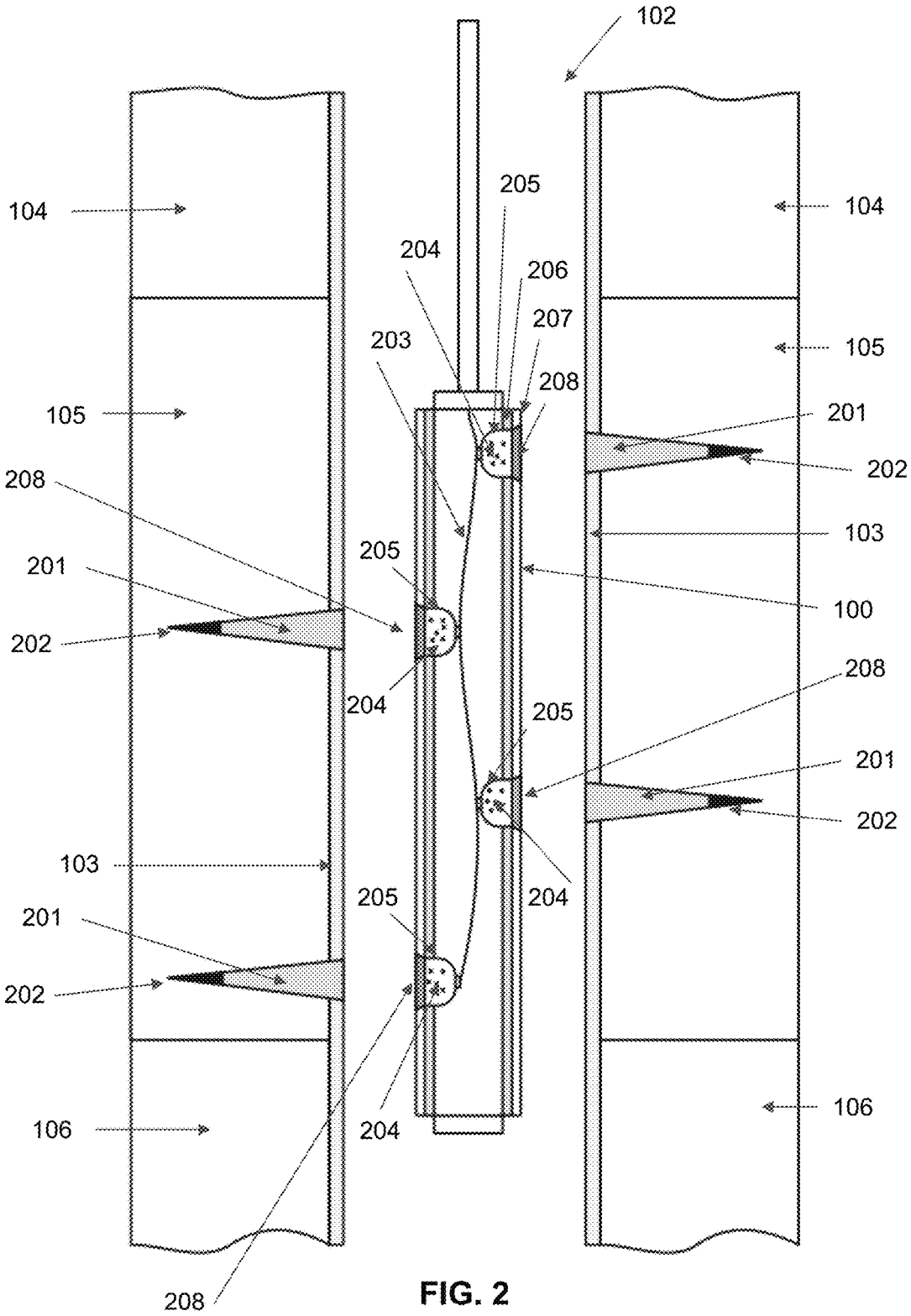
FIG. 2 is a schematic cross-sectional diagram showing a perforating apparatus following a perforating event.

Referring to FIG. 2, a schematic diagram shows a cross-sectional of a perforating apparatus 100. The perforating apparatus 100 is shown positioned within wellbore 102, aligned with one or more desired strata 104, 105, 106. The wellbore 102 may be lined with a metal casing 103. As shown in FIG. 2, explosive charges have been detonated by the detonating cord 203. The method of initiating the explosive train may include, among others, the use of an electrical signal, a mechanical signal, a pressure activating signal and/or combinations thereof.

After the detonation, empty charge cavities 205 have been created in the perforating apparatus 100 where the fired charges were originally located. Missile-like charge payloads 202 are shown, post detonation, that have been powered by the perforation jet to penetrate through a self-sealing material 206 and outer wall 207 of the perforating apparatus 100 thereby forming a plurality of 'exit' holes 208 in the outer wall 207. The charge payloads 202 are shown embedded deep within the desired formation strata 105. It is unlikely that these charge payloads 202 will ever be pushed back into the perforating apparatus 100, as they are typically embedded deep within the strata 105. The charge payloads 202 may include fragments of the perforating apparatus and internal components which fragment as the explosive train travels through the perforating apparatus. The charge payloads 202 may also include a bullet, which may be formed from any suitable material, including but not limited to one or more metals. The charge payloads are optional, because a charge such as a bullet is not always necessary. According to certain embodiments, a perforation tunnel or channel 201 may be formed by a perforating jet caused by detonation of a charge contained within a charge cavity 205 of the perforating apparatus 100.

Some residual charge debris 204 is also shown in the charge cavity 205, wherein charges were originally positioned. The charge debris primarily contains, but is not limited to fragments of the perforating apparatus, and internal components which fragment as the explosive train travels through the perforating apparatus.

Each of the plurality of charge liners/debris payloads 202 is also shown having blasted through the metal wellbore casing/tubing 103 and into the one or more strata 104, 105, 106 to form a perforation tunnel or channel 201.

According to various embodiments, the self-sealing material 206 effectively seals the exit holes 208 in the outer wall 207 of the perforating apparatus 100 to prevent any debris, such as the payloads 202 from entering the perforating apparatus 100 and also to prevent any residual charge debris 204 from exiting the perforating apparatus 100.

Figure 3:
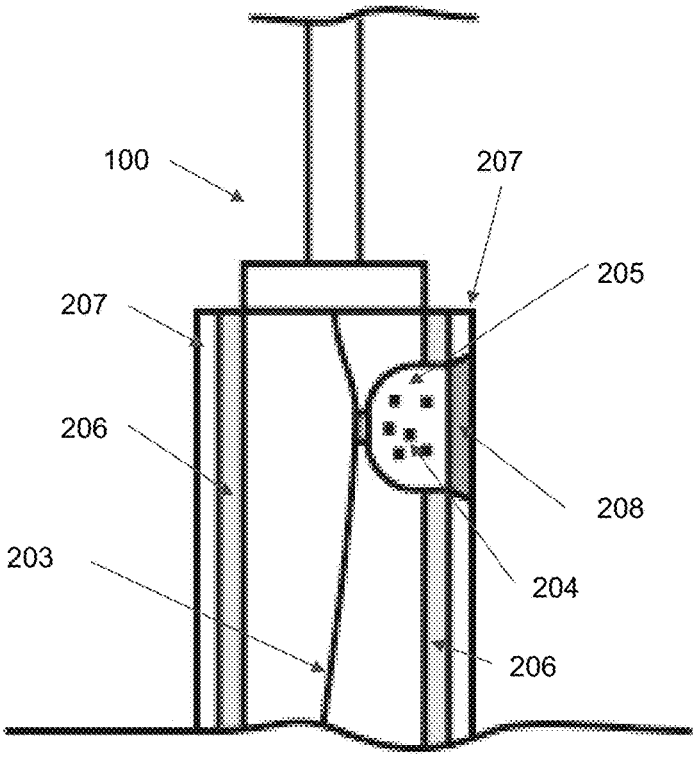
FIG. 3 is an enlarged view of the schematic cross-sectional diagram highlighting the self-sealing feature of the perforating apparatus shown in FIG. 2.

FIG. 3 is an enlarged view of the schematic cross-sectional diagram of a perforating apparatus 100 as depicted in FIG. 2. A plurality of holes 208 have been blasted through a self-sealing material 206 and through an outer wall 207 of the perforating apparatus 100. Debris 204 is shown contained within the charge cavity 205 by the self-sealing material 206.

Figure 4:
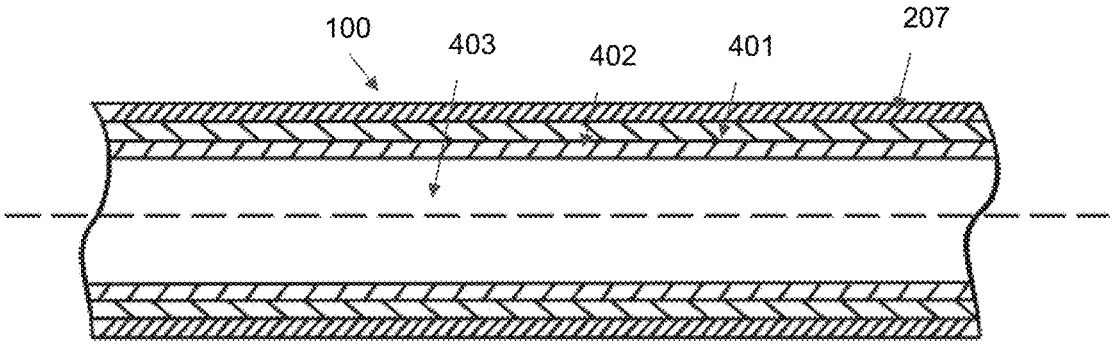
FIGS. 4, 5, 6, 7A, 7B, 8, 9, and 10 are schematic cross-sectional diagrams showing various embodiments of a perforating apparatus.

FIG. 4 is a schematic cross-sectional diagram of an example perforating apparatus 100. The perforating apparatus 100 includes an outer wall 207 with a self-sealing material 401 lining an interior surface of the outer wall 207. A liner layer 402 may separate the self-sealing material 401 from an inner cavity 403 of the perforating apparatus. The liner layer 402 may be used to isolate the self-sealing material 401 from energetic/explosives material components housed inside the perforating apparatus, thereby providing a method to mitigate possible chemical and material compatibility issues. Without the liner layer 402, some types of self-sealing materials 401 could degrade the potency of the explosive material or degrade the housing for the explosive material. Over time and at certain temperatures, the self-sealing material may emit gas materials that could interact with the charges. The gas materials may include but are not limited to plasticizers contained in the self-sealing material 401. According to various embodiments, the liner layer may be gas impermeable.

Figure 5:
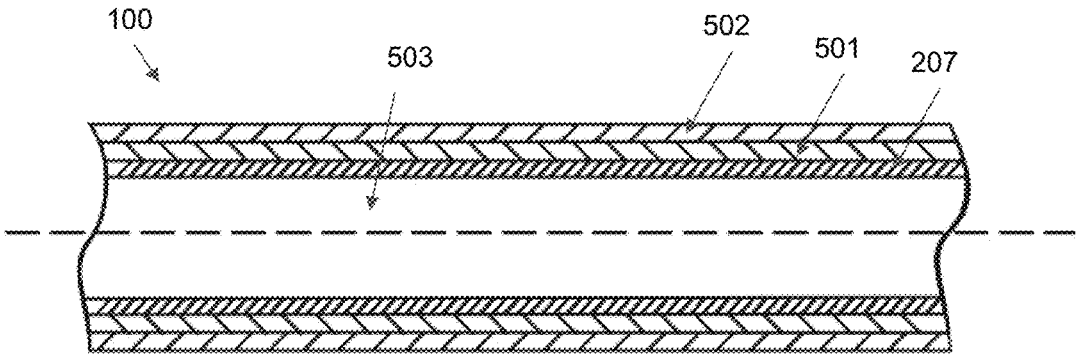

FIG. 5 is a schematic cross-sectional diagram of a perforating apparatus 100. The perforating apparatus 100 may include an outer wall 207 defining an inner cavity 503. A self-sealing material 501 may line an exterior surface of the outer wall 207. A liner layer 502 may line the self-sealing material 501 to protect it from the environment.

Figure 6:
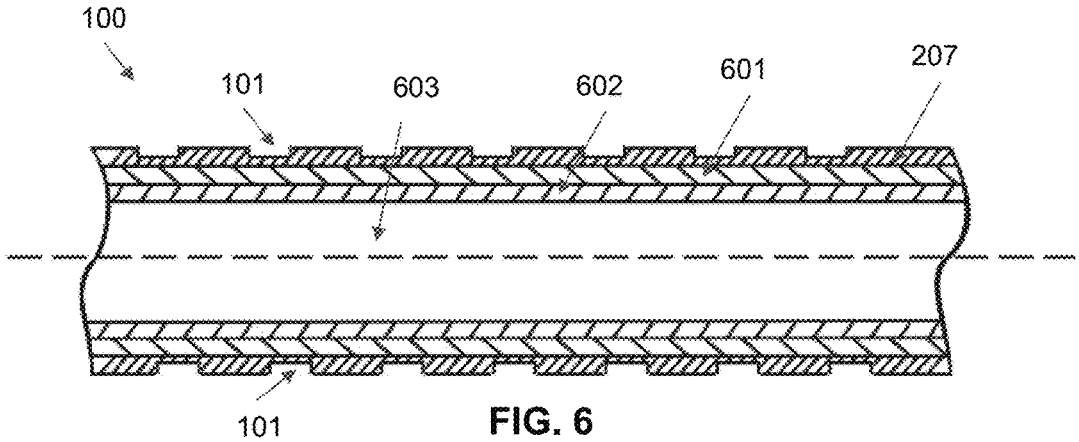

FIG. 6 is a schematic cross-sectional diagram of an embodiment of a perforating apparatus 100. The perforating apparatus 100 may include an outer wall 207, having one or more scallops 101 formed therein. The scallops 101 may be aligned with one or more payloads mounted within the perforating apparatus 100 to reduce the cross-sectional thickness of the wall 207 through which the perforating jet or payload must penetrate to exit the perforating apparatus. A self-sealing material 601 may line an interior surface of the outer wall 207. A liner layer 602 may separate the self-sealing material 601 from an inner cavity 603 of the perforating apparatus. The liner layer 602 may isolate the self-sealing material 601 from energetic/explosives material components housed inside the perforating apparatus, thereby providing a method to mitigate possible chemical and material compatibility issues. Without the liner layer 602, some types of self-sealing materials 601 could degrade the potency of the explosive material or degrade the housing for the explosive material. Over time and at certain temperatures, the self-sealing material could off-gas materials that could interact with the charges. The off-gas materials may include but are not limited to plasticizers contained in the self-sealing material 601. According to various embodiments, the liner layer may be gas impermeable.

Figure 7A:
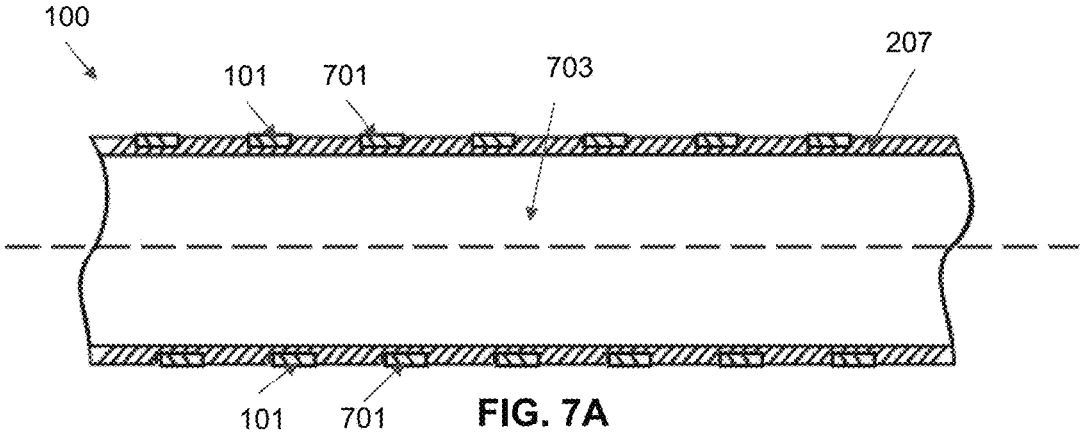
Figure 7B:
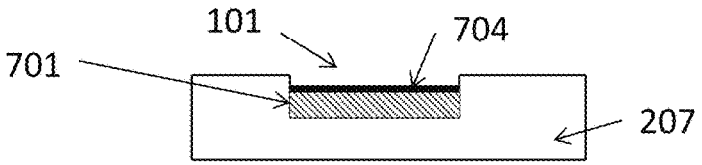

FIGS. 7A and 7B are schematic cross-sectional diagrams of an embodiment of a perforating apparatus 100. The perforating apparatus 100 may include an outer wall 207, having one or more scallops 101 formed therein. The wall 207 may define an inner cavity 703. The scallops 101 may be aligned with one or more payloads to reduce the cross-sectional thickness of the wall 207 through which the payloads must penetrate to exit the perforating apparatus. A self-sealing material 701 may partially or completely fill the scallops 101. FIG. 7B also shows a barrier seal 704, exemplarily constructed from a foil, that covers the self-sealing material 701.

Figure 8:
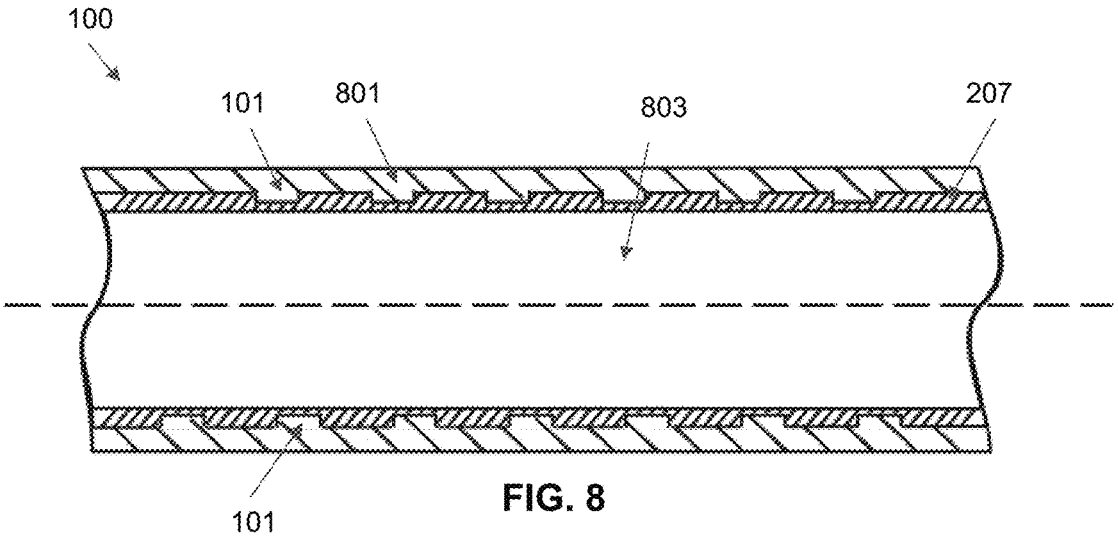

FIG. 8 is a schematic cross-sectional diagram of an embodiment of a perforating apparatus 100. The perforating apparatus 100 may include an outer wall 207, having one or more scallops 101 formed therein. The wall 207 may define an inner cavity 803. The scallops 101 may be aligned with one or more charges or payloads to reduce the cross-sectional thickness of the wall 207 through which the payloads must penetrate to exit the perforating apparatus. A self-sealing material 801 may line an exterior surface of the outer wall 207, partially or completely filling the scallops 101.

Figure 9:
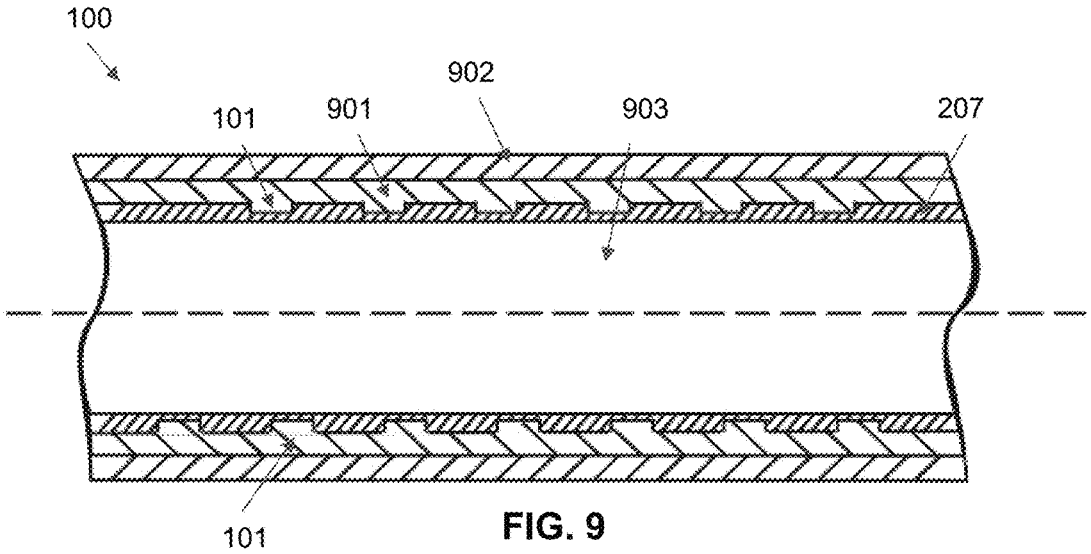

FIG. 9 is a schematic cross-sectional diagram of an embodiment of a perforating apparatus 100. The perforating apparatus 100 may include an outer wall 207, having one or more scallops 101 formed therein. The outer wall 207 may define an inner cavity 903. The scallops 101 may be aligned with one or more charges or payloads to reduce the cross-sectional thickness of the wall 207 through which the payload or perforating jet must penetrate to exit the perforating apparatus. A self-sealing material 901 may line an exterior surface of the outer wall 207, partially or completely filling the scallops 101. A liner layer 902 may line an exterior surface of the self-sealing material 901 to protect the exterior surface of the self-sealing material from the environment surrounding the perforating apparatus 100.

Figure 10:
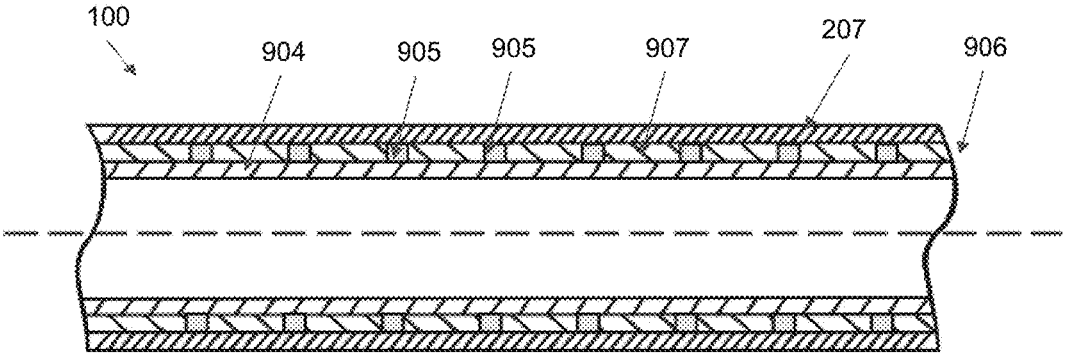

FIG. 10 is a schematic cross-sectional diagram of an embodiment of a perforating apparatus 100. The perforating apparatus 100 may include an outer wall 207. A rigid liner layer 904 may be secured to the outer wall 207 of the perforating apparatus 100 by one or more securing elements 905. The securing elements may be spacers, bolts, rivets, rods or other suitable implements, which extend between the rigid liner layer 904 and the outer wall 207 to secure the rigid liner layer 904 to the outer wall 207. The rigid liner layer 904 and the outer wall 207 may form an annular gap 906 into which a sealing material 907 may be inserted to partially or completely fill the annular gap.

According to various embodiments, when the self-sealing material is an expandable polymer, the expandable polymer material may be adequately protected from the detonation of the perforating gun by positioning the expandable polymer material inside containers or behind shielding within the perforation gun. According to other embodiments, the expandable polymer material may be directly exposed to the detonation. Advantageously, however, incorporation of the expandable polymer materials between the charge carrier and gun wall may provide a secondary benefit of lateral shock protection during handling and transport.

According to various embodiments as described herein, the self-sealing material may be integrated in a way that does not affect charge performance or gun survival. In some examples the self-sealing material may be positioned to avoid increased internal gun pressures or annulus pressures, for example from the presence of the expandable polymer material which may make up the self-sealing material. In some examples, the self-sealing material may be in close proximity to exit holes on the internal diameter of the perforating gun and thereby positioned to prevent debris from exiting the perforating gun.

Various embodiments within this disclosure relate to a method of manufacturing a perforating apparatus that includes a wall, a liner layer adjacent to an inner surface of the wall, and a self-sealing material disposed between the wall and the liner layer. The self-sealing material may be any self-sealing material described herein that is capable of sealing one or more holes in the wall. The method may include disposing the liner layer within the perforating apparatus to form an annular gap between the liner layer and the wall and injecting the self-sealing material into the annular gap. The liner layer may optionally be secured to the inner surface of the wall.

The self-sealing materials described herein may serve to seal any hole created in the outer wall of the perforating apparatus after a payload is discharged. Sealing of such holes minimizes or eliminates debris from entering the wellbore. The debris may include but is not limited to charge case debris, charge tube debris, end alignment fixture debris, fragments of the outer wall of the perforating apparatus or any other internal part of the perforating apparatus. The outer wall of the perforating apparatus may be made of any suitable material such as an aluminum alloy, zinc, steel, carbon steel or carbonated steel.

The perforating apparatus may have any diameter, and may be sized to accommodate the size and shape of the borehole and casing. For example, according to at least one embodiment, a perforating apparatus may have a diameter within a range having a lower limit and/or an upper limit. The range may include or exclude the lower limit and/or the upper limit. For example, the range may be any range, selected for example from 1 to 12 inches, or alternatively from 1 to 10 inches, or alternatively from 2 to 8 inches, or alternatively from 2 to 7 inches, or any combination of the aforementioned sizes or sizes therebetween. For example, the perforating apparatus of the various embodiments described herein may have a diameter of from 2 to 7 inches.

In at least one embodiment within this disclosure, the perforating jet, payload, and/or bullet may penetrate the outer wall of the perforating apparatus to leave an exit hole having any diameter. For example, according to various embodiments, the exit hole may have a diameter within a range having a lower limit and/or an upper limit. The range may include or exclude the lower limit and/or the upper limit. For example, the range may be any range, selected for example from 0.1 to 1.5 inches, or alternatively from 0.2 to 1.25 inches, or alternatively from, 0.2 to 1 inch, or alternatively from 0.25 to 0.75 inches, or any combination of the aforementioned sizes or sizes therebetween. In at least one embodiment of this disclosure, the perforating jet, payload, and/or bullet that is fired through the outer wall of the perforating apparatus may leave a hole having a diameter greater than 0.1 inches, or from 0.25 to 0.75 inches.

In at least one embodiment of this disclosure, a self-sealing material may have a thickness that is selected depending on the size of the hole that is desired or expected to be created in the outer wall of the perforating apparatus. A ratio of the thickness of the self-sealing material to the diameter of the hole created by the perforating jet, payload, and/or bullet in the outer wall of the perforating apparatus may be within any range. For example, the ratio of the thickness of the self-sealing material to the diameter of the hole created by the perforating jet, payload, and/or bullet may be in a range of from 0.1:10 to 10 to 0.1, and all ratios therebetween.

According to various embodiments, the one or more holes may be formed by discharging an explosive device within the perforating apparatus, and a ratio of the volume of the self-sealing material to an average diameter of the one or more holes may be proportional to a volumetric expansion of the self-sealing material caused by discharging the explosive device within the perforating apparatus.

In at least one embodiment within this disclosure, a self-sealing material may have a thickness within a range having a lower limit and/or an upper limit. The range may include or exclude the lower limit and/or the upper limit. The lower limit and/or upper limit may be selected from any thickness. For example, the range may be any range, selected for example from 0.05 inches to 5 inches, or alternatively from 0.1 to 4 inches, or alternatively from 0.1 to 3 inches, or alternatively from 0.25 to 3 inches, or any combination of the aforementioned sizes or sizes therebetween. In at least one embodiment within this disclosure, the self-sealing material may have a thickness of from 0.1 inches to 3 inches, or from 0.25 inches to 3 inches.

As discussed above, the perforating apparatus 100 may include one or more scallops 101. In at least one embodiment within this disclosure, the scallops may be cut into the outer wall of the perforating apparatus. The scallops may be any shape, including but not limited to square, triangular, rectangular, ellipsoid, and circular. The scallops may have a diameter within a range having a lower limit and/or an upper limit. The range may include or exclude the lower limit and/or the upper limit. The lower limit and/or upper limit may be selected from any diameter. For example, the range may be any range, selected for example from 0.05 inches to 4 inches, or alternatively from 0.5 inches to 3 inches, or alternatively from 0.1 to 2 inches, or alternatively from 0.1 to 1 inch, or alternatively from 0.1 inch to 0.75 inches, or any combination of the aforementioned sizes or sizes therebetween. In at least one embodiment, the scallops may have a diameter of 0.10 inches or greater or of from 0.25 to 0.75 inches.

In at least one embodiment within this disclosure, the spot face/scallops may have any depth. For example, according to various embodiments the spot face/scallops may have a depth within a range having a lower limit and/or an upper limit. The range may include or exclude the lower limit and/or the upper limit. For example, the range may be any range, selected for example from 0.05 to 2 inches, or alternatively from 0.1 to 1 inch, or any combination of the aforementioned depths or depths therebetween. In at least one embodiment, the scallops may have a depth of from 0.1 to 1 inch.

In at least one embodiment within this disclosure, a liner layer may have a thickness within a range having a lower limit and/or an upper limit. The range may include or exclude the lower limit and/or the upper limit. The lower limit and/or upper limit may be of any thickness. For example, the range may be any range, selected for example from 0.001 to 2 inches, or alternatively from 0.002 to 1 inch. In at least one embodiment, the liner layer may have a thickness of from 0.001 to 1 inch.

In at least one embodiment within this disclosure, a self-sealing material may include a single component or a plurality of components, such as a composite of several self-sealing materials or sealants. The self-sealing material may include any material capable of plastic deformation. The self-sealing material may be an expandable polymer material. The self-sealing material may include one selected from an expandable polymer material, a swelling elastomer, a rubber, and combinations thereof.

The expandable polymer material may be ethylene vinyl acetate (EVA), chlorinated polyethylene (CPE), chlorosulfonated polyethylene (CSM), a polyacrylate, and combinations thereof.

The swelling elastomer may be a fluoroelastomer (FKM) as defined in ASTM D1418, a perfluoro-elastomer (FFKM), fluorosilicone, tetrafluoroethylen-propglene copolymer (TFE/P), and combinations thereof.

The rubber may be natural rubber, neoprene rubber, fluorosilicone rubber, silicon rubber, fluoro-rubber, uncured rubber, semi-cured rubber, synthetic rubber, cyclicized rubber, polysulfide rubber, and combinations thereof.

The synthetic rubber may be ethylene propylene diene monomer rubber (EPDM), butyl rubber, polychloroprene, Epichlorohydrin rubber (ECO), nitrile rubber (NBR), hydrogenated nitrile rubber (HNBR), a copolymer of isoprene and methylpentadiene, a copolymer of butadiene-methylpentadiene, and combinations thereof.

Various embodiments integrate an expandable polymer material inside perforation guns to lock in debris from charge cases and charge carriers after detonation.

According to various embodiments and applications, the particular expandable polymer material must meet one or more requirements. Generally, the expandable polymer material must be able to survive in a perforation gun detonation environment. The particular environment may differ depending on whether the expandable polymer material is disposed within the perforation gun or on an outside surface of the perforation gun, possibly inside a scallop on the perforation gun's surface. The expandable polymer typically must be selected and positioned such that it will survive a detonation of the perforation gun and stay in place during fluid in-rush after detonation. The expandable polymer material must often be adapted to be compatible with the gun assembly and manufacturing processes. Additionally, in some cases, the expandable polymer must be adapted according to various environmental regulations/considerations.

In certain embodiments, the expandable polymer material must be able to withstand an operating temperature greater than 150 degrees Celsius. The expandable polymer may, therefore, have an operating temperature within a range having a lower limit and/or an upper limit. The range may include or exclude the lower limit and/or the upper limit. The lower limit and/or upper limit may be selected from 0 to 200 degrees Celsius depending on subterranean conditions.

According to certain embodiments, the expandable polymer material must be able to withstand an operating pressure of up to 30,000 psi. The expandable polymer may, therefore, have an operating differential pressure capability within a range having a lower limit and/or an upper limit. The range may include or exclude the lower limit and/or the upper limit, each of which may range from as low as just above zero psi to as high as 40,000 psi. For example, according to certain preferred embodiments, the expandable polymer may have an operating differential pressure capability of from 5,000 to 30,000 psi, depending on subterranean conditions.

According to certain embodiments, the expandable polymer material must be compatible with a variety of wellbore fluids, including but not limited to hydrocarbons, salt water, fracturing fluids, gelling fluids, drilling fluids or other fluids prior, during or after fracturing and drilling operations.

According to certain embodiments, the expandable polymer material may swell enough to seal a hole formed in the surface of a perforation gun within a suitable time period. In various applications the expandable polymer may swell for example by 50 to 200%, or 100% to 250% or more.

According to various embodiments, the expandable polymer material must be provided in an amount sufficient to seal the exit hole created in the surface of the perforation device after detonation. However, the amount of expandable polymer material is limited to an amount that does not affect charge performance within the perforation gun.

At least three different types of swelling elastomers may be employed, including but not limited to oil-swelling elastomers, water-swelling elastomers, and hybrid-swelling elastomers. For purposes of the present disclosure, the term "oil-swelling elastomer" means an elastomer that swells in the presence of an oil. For purposes of the present disclosure, the term "water-swelling elastomer" means an elastomer that swells in the presence of water. For purposes of the present disclosure, the term "hybrid-swelling elastomer" means an elastomer that swells in the presence of an oil (hydocarbons) and/or in the presence of water.

In oil-swelling, water-swelling, and hybrid-swelling elastomers, the swelling, i.e. the volume expansion, of the elastomer may be the result of an entropy difference between the elastomer and the environment in which it is being used. Upon contact with fluids and under the correct conditions, elastomers may, and usually do, swell. Many variables may affect the degree of swell. For example, swelling may be affected by ingredient quality, mixing order, vulcanization, temperature, salinity, and pH. The swelling rate may depend on the temperature, pressure, type of elastomer and the fluid composition. Some differences exist between the mechanisms by which swell occurs between the elastomer and the solvent in oil and water swelling. Depending upon the base elastomer, swell may vary from a negligible degree of swell to a large swell of 100-200%. The term "base elastomer" refers to the elastomer matrix that is utilized and which may include, but is not limited to, acrylonitrile-butadiene rubber (NBR), hydrogenated nitrile butadiene rubber (HNBR), ethylene propylene diene monomer rubber (EPDM), and silicones.

An oil-swelling elastomer generally swells through a diffusion-absorption process, wherein oil particles penetrate the cross-linked chains of the elastomer to swell the elastomer. The swell time and the swell volume of an oil-swelling elastomer may be governed by temperature and by the hydrocarbon composition of the oil-swelling elastomer. The swelling speed of oil-swelling elastomers may be customized because the oil swell rate of oil-swelling elastomers may be faster at higher temperatures and in lighter hydrocarbons.

Natural-gas condensate is a low-density mixture of hydrocarbon liquids present as gaseous components in the raw natural gas produced from many natural gas fields. It condenses out of the raw gas if the temperature is reduced to below the hydrocarbon dew point temperature of the raw gas. The natural gas condensate is also referred to as simply condensate, or gas condensate, or sometimes natural gasoline because it contains hydrocarbons within the gasoline boiling range.

Raw natural gas may come from any one of three types of gas wells: crude oil wells, dry gas wells, and condensate wells. Raw natural gas that comes from crude oil wells is called associated gas. This gas may exist separate from the crude oil in the underground formation, or dissolved in the crude oil. Condensate produced from oil wells is often referred to as lease condensate. Dry gas wells typically produce only raw natural gas that does not contain any hydrocarbon liquids. Such gas is called non-associated gas. Condensate from dry gas is extracted at gas processing plants and, hence, is often referred to as plant condensate. Condensate wells produce raw natural gas along with natural gas liquid. Such gas is also non-associated gas and often referred to as wet gas. Oil-swelling elastomers typically swell in condensate and in wet gas.

A water-swelling elastomer will typically swell in water and/or in water vapor. The swelling speed of a water-swelling elastomer may be customized, because the swell time and swell volume are typically governed by water temperature and water salinity. The swelling rate is generally faster at higher temperatures and lower salinities. Water-swell elastomers may be made by blending in a super absorbent polymer (SAP) into the base elastomer compound. Superabsorbent polymers are polymers that may absorb and retain extremely large amounts of a liquid relative to their own mass.

A hybrid-swelling elastomer is capable of swelling in hydrocarbon solutions, water-based solutions, and combinations thereof. A hybrid-swelling elastomer may be a combination of an oil-swelling elastomer and a water-swelling elastomer. The swelling speed may be customized for a particular activation fluid (independent swell control)

A hybrid-swelling polymer may be a single homogeneous piece of material and may, but need not be made up of a water-swelling section and an oil-swelling section.

Figure 12:
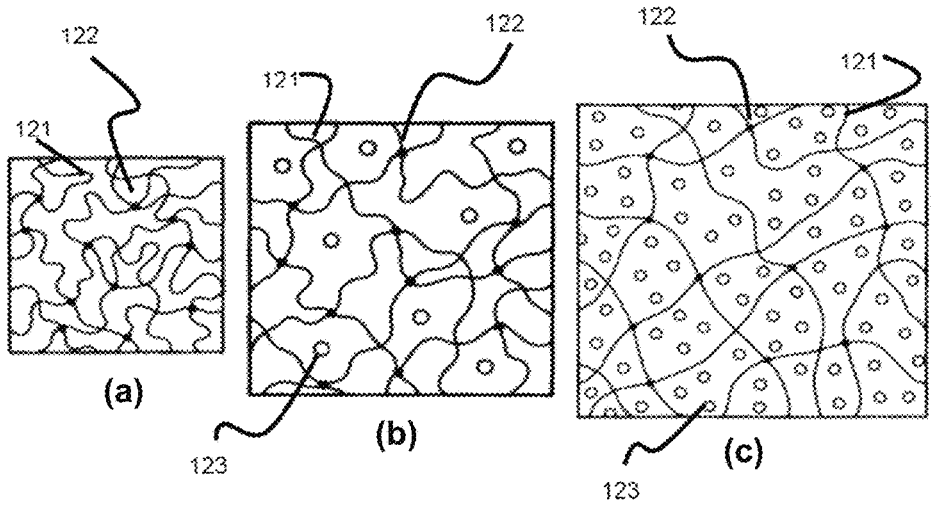
FIG. 12(*a*) is a schematic diagram illustrating chains of elastomers that are cross-linked together at a variety of points.

FIG. 12(*a*) is a schematic diagram of chains 121 of elastomers that are cross-linked together at a variety of points 122.

FIG. 12(*b*) is a schematic diagram of the elastomers shown in FIG. 12(*a*) in a partially swollen state. Solvent molecules 123 are shown as having penetrated the chains 121, causing the volume of the elastomer to expand.

FIG. 12(*c*) is a schematic diagram of the elastomers shown in FIGS. 12(*a*) and 12(*b*) in an extensively swollen state. Additional solvent molecules 123 are shown having penetrated the chains 121, causing further swelling. The solvent molecules illustrated may be an oil, a water, and combinations thereof.

The self-sealing material may also include other components including but not limited to plasticizers, and wetting agents.

Figure 11:
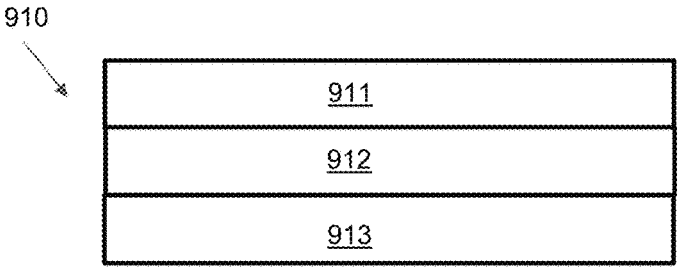
FIG. 11 is a schematic diagram showing a cross section of a multi-layered self-sealing material.

The self-sealing material may comprise one layer or a plurality of layers as illustrated in FIG. 11. More specifically, FIG. 11 shows a self-sealing material 910 including a plurality of layers 911, 912, and 913. The plurality of layers may range from as few as two layers to any number thereabove.

In at least one embodiment, a liner layer may include a metallic alloy comprising aluminum, copper, tin, or gold. The liner layer may be in the form of a thin sheet of metal. The liner layer may be partially or completely gas impermeable. The liner layer may include a thermoplastic, a thermoset, or a resin. The liner layer may include a polyethylene or polypropylene film. The liner layer(s) may be heat resistant such that it may withstand a temperature in a range of from 200 to 400 degrees Fahrenheit without deteriorating.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the claims. It will therefore be appreciated that the embodiments described above may be modified within the scope of the appended claims.

Any element in a claim that does not explicitly state "means for" performing a specified function, or "step for" performing a specific function, is not to be interpreted as a "means" or "step" clause as specified in 35 U.S.C § 112, sixth paragraph. In particular, the use of "step of" in the claims herein is not intended to invoke the provisions of 35 U.S.C § 112, sixth paragraph.

What is claimed is:

1. A perforating apparatus comprising:

a wall forming an inner cavity;

a self-sealing material disposed adjacent to the wall;

an explosive device positioned to form a hole through the wall and the self-sealing material, wherein the self-sealing material is capable of sealing the hole formed in the wall and the self-sealing material by the explosive device; and a liner layer disposed inside the perforating apparatus between the self-sealing material and the inner cavity, wherein the liner layer is secured to an inner surface of the wall and is spaced from the inner surface to form an annular gap, and the self-sealing material is disposed within the annular gap.

2. The perforating apparatus according to claim 1, wherein the one or more holes have an average diameter in the range of 0.10 inches to 1.5 inches.

3. The perforating apparatus according to claim 1, wherein the self-sealing material prevents debris generated by the explosive device from passing through the hole formed in the wall and the self-sealing material.

4. The perforating apparatus according to claim 1, wherein the self-sealing material is disposed within the perforating apparatus adjacent to an interior surface of the wall.

5. The perforating apparatus according to claim 1, wherein the self-sealing material is disposed outside the perforating apparatus adjacent to an exterior surface of the wall.

6. The perforating apparatus according to claim 1, wherein the self-sealing material comprises at least one selected from the group consisting of an expandable polymer material, a swelling elastomer, and a rubber.

7. The perforating apparatus according to claim 1, wherein the self-sealing material has a thickness of 0.10 inches to 3 inches.

8. The perforating apparatus according to claim 1, wherein:

the one or more holes are formed by discharging an explosive device within the perforating apparatus; and a ratio of a volume of the self-sealing material to an average diameter of the one or more holes is proportional to a volumetric expansion of the self-sealing material caused by discharging the explosive device within the perforating apparatus.

9. The perforating apparatus according to claim 1, wherein the liner layer comprises a metallic alloy.

10. The perforating apparatus according to claim 1, wherein the liner layer comprises a plastic material.

11. The perforating apparatus according to claim 1, wherein the liner layer is at least partially gas impermeable.

12. The perforating apparatus according to claim 1, wherein the liner layer has a thickness of from 0.001 to 1 inch.

13. The perforating apparatus according to claim 1, wherein the liner layer is disposed inside the perforating apparatus, and wherein the self-sealing material is disposed between the perforating apparatus and an interior surface of the wall.

14. The perforating apparatus according to claim 1, wherein the liner layer is disposed outside the perforating apparatus, and wherein the self-sealing material is disposed between the perforating apparatus and an exterior surface of the wall.

15. The perforating apparatus according to claim 1, wherein the wall comprises one or more spot face/scallops.

16. The perforating apparatus according to claim 15, wherein the self-sealing material at least partially fills the one or more scallops.

17. A method of manufacturing a perforating apparatus, the perforating apparatus comprising:

a wall;

a liner layer adjacent to an inner cavity of the perforating apparatus, wherein the liner layer is secured to an inner surface of the wall and is spaced from the inner surface to form an annular gap; and a self-sealing material disposed within the annular gap, wherein the self-sealing material is capable of sealing one or more holes in the wall; and the method comprising:

disposing the liner layer within the perforating apparatus to form an annular gap between the liner layer and the wall; and injecting the self-sealing material into the annular gap.

18. The method according to claim 17, further comprising securing the liner layer to the inner surface of the wall.

* * * * *